US006914512B2

(12) United States Patent
Park et al.

(10) Patent No.: US 6,914,512 B2
(45) Date of Patent: Jul. 5, 2005

(54) 3-LINE BALUN TRANSFORMER

(75) Inventors: Dong Seok Park, Seoul (KR); Nam Chul Kim, Daejeon (KR); Jeong Ho Yoon, Kyungki-do (KR); Byoung Hwa Lee, Kyungki-do (KR); Sang Soo Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/461,334

(22) Filed: Jun. 16, 2003

(65) Prior Publication Data

US 2004/0061581 A1 Apr. 1, 2004

(30) Foreign Application Priority Data

Sep. 27, 2002 (KR) ..... 2002-58748

(51) Int. Cl.[7] ..... H01F 27/28
(52) U.S. Cl. ..... 336/232; 336/223; 333/32
(58) Field of Search ..... 336/200, 223, 336/232; 333/15, 16, 33, 32

(56) References Cited

U.S. PATENT DOCUMENTS 5,497,137 A * 3/1996 Fujiki ..... 336/200
6,018,277 A 1/2000 Väisänen
6,040,745 A * 3/2000 Tanaka et al. ..... 333/26
6,140,886 A * 10/2000 Fratti et al. ..... 333/26
6,285,273 B1 9/2001 Morikawa
6,294,965 B1 9/2001 Merrill et al.
6,483,415 B1 * 11/2002 Tang ..... 336/200

OTHER PUBLICATIONS

Patent Abstracts of Japan—Publication No. 03–254204, Published Nov. 13, 1991.
Patent Abstracts of Japan—Publication No. 07–183127, Published Jul. 21, 1995.
Cho, Choonsik, K. C. Gupta. "A New Design Procedure for Single–Layer and Two–Layer Three–Line Baluns." IEEE Transactions on Microwave Theory and Techniques, vol. 46, No. 12 Dec. 1998, pp. 2514–2519.

* cited by examiner

*Primary Examiner*—Anh Mai
(74) *Attorney, Agent, or Firm*—Lowe Hauptman & Berner, LLP

(57) ABSTRACT

A 3-line balun transformer includes an unbalanced port for an unbalanced signal, first and second balanced ports for balanced signals, the balanced signals being the same in level and 180 degrees out of phase with each other, a first line having its first end connected to the unbalanced port and its second end connected to ground, a second line arranged in parallel with the first line while being spaced apart from the first line, the second line having its first end and its second end connected to the first balanced port, and a third line arranged in parallel with the second line while being spaced apart from the second, the third line having its first end connected to the first end of the second line and its second end connected to the second balanced port.

34 Claims, 15 Drawing Sheets

3-LINE BALUN TRANSFORMER

BACKGROUND OF THE INVENTION

1. Field of the Invention

The present invention relates to a balun transformer for converting balanced signals into an unbalanced signal or vice versa, and more particularly to a 3-line balun transformer which has a simple structure and is easy to design and manufacture.

2. Description of the Related Art

Generally, "balun" is an abbreviation for 'balance to unbalance', which typically signifies a circuit or structure for converting balanced signals into an unbalanced signal or vice versa.

For example, a balun transformer may be required in a wireless communication field to connect a mixer, amplifier, etc. including balanced lines with components including unbalanced lines.

A balun transformer may be implemented with a combination of transmission lines or a concentrated constant circuit, or in the form of a resonant waveguide in the case where it is employed in an antenna field.

FIG. 1 is an equivalent circuit diagram of a conventional balun transformer proposed by Marchand. As shown in this drawing, the conventional balun transformer comprises four transmission lines 11~14, each having a length of λ/4 (here, λ is 1/fc (fc is a center frequency of an input/output signal)). The first and third lines 11 and 13, and the second and fourth lines 12 and 14 form couplers, respectively. The first line 11 has its one end connected to an unbalanced port 15 for input or output of an unbalanced signal of a predetermined frequency and its other end connected to one end of the second line 12, the other end of which remains open. The third and fourth lines 13 and 14, coupled respectively with the first and second lines 11 and 12, have their one ends connected to ground and their other ends connected respectively to balanced ports 16 and 17 for input or output of two balanced signals.

In the above structure, if a signal of a predetermined frequency is applied to the unbalanced port 15, then an inter-line electromagnetic coupling occurs, thereby causing the balanced ports 16 and 17 to output signals which are the same in level and 180 degrees out of phase with each other, respectively.

To the contrary, if signals with the same levels and a phase difference of 180° therebetween are applied respectively to the balanced ports 16 and 17, then an unbalanced signal is outputted from the unbalanced port 15.

FIG. 2 is an equivalent circuit diagram of another conventional balun transformer. As shown in this drawing, the conventional balun transformer comprises first to fourth lines 21~24 which form two couplers, in a similar manner to that of FIG. 1. The structure of FIG. 2 is different from that of FIG. 1 in that the third line 23 has its one end connected to an unbalanced port 27 and its other end connected to ground, the first line 21 and second line 22 have their one ends connected to each other and their other ends connected respectively to balanced ports 25 and 26, and the fourth line 24 has its both ends connected to the ground. If the two couplers have the same structures, they must be in symmetrical relation to each other.

However, because the balun transformers shown in FIGS. 1 and 2 are implemented with the four lines, each having the length of λ/4, there is a need for a simpler structure. Further, the balun transformer of FIG. 2 is very hard to manufacture because the two couplers thereof are proposed to have a symmetrical structure.

In order to overcome the above problems, there has been proposed a balun transformer having a simpler structure consisting of three lines, as shown in FIG. 3. This balun transformer has a structure employing an equivalent, second line 32 to replace the right coupler in the structure of FIG. 2. Here, the left coupler has a symmetrical structure.

FIG. 4 shows the structure of another balun transformer consisting of three lines. As shown in this drawing, the balun transformer comprises first to third lines 41~43 which are arranged in parallel to form inter-line couplings. The first and second lines 41 and 42 have their one ends connected in common to an unbalanced port 44, the first line 41 has its other end connected to a balanced port 45, and the third line 43 has its one end connected to a balanced port 46. The middle or second line 42 and third line 43 have their other ends connected to ground.

The above-mentioned balun transformer 40 is simpler in structure than 4-line balun transformers, but is disadvantageous in that a branching point 44*a* must be formed in the unbalanced port 44, resulting in unnecessary reflection of high frequency signals.

SUMMARY OF THE INVENTION

Therefore, the present invention has been made in view of the above problems, and it is an object of the present invention to provide a 3-line balun transformer which has a simple structure and is easy to design and manufacture.

In accordance with the present invention, the above and other objects can be accomplished by the provision of a 3-line balun transformer comprising an unbalanced port for inputting or outputting an unbalanced signal; first and second balanced ports for outputting or inputting balanced signals, respectively, the balanced signals being the same in level and 180 degrees out of phase with each other; a first line having its first end connected to the unbalanced port and its second end connected to ground; a second line arranged in parallel with the first line while being spaced apart from the first line by a predetermined distance, the second line having its first end and its second end connected to the first balanced port; and a third line arranged in parallel with the second line while being spaced apart from the second line by a predetermined distance, the third line having its first end connected to the first end of the second line and its second end connected to the second balanced port.

Preferably, the first, second and third lines each may have a length of λ/4 (λ is a wavelength at a center frequency of an input/output signal).

Further, preferably, the 3-line balun transformer can be miniaturized through the use of the three lines.

Further, preferably, the 3-line balun transformer may satisfy an impedance condition expressed by the following equation:

$$\frac{1}{Z_{13}} - \frac{1}{Z_{12}} = \frac{1}{Z_{22}} - \frac{1}{Z_{33}} = \pm\sqrt{\frac{2}{Z_{0u}Z_{0b}}}$$

where, $z_{mn}$ (m,n=1,2,3) is a characteristic impedance between an mth line and an nth line, $Z_{0u}$ is a termination impedance of the unbalanced port, and $Z_{0b}$ is a termination impedance of each of the first and second balanced ports.

In a feature of the present invention, all couplings among the three lines and all couplings between the lines and the ground need not exist in order to enable the transformer to operate as a balun. Conditions can be found which enable the transformer to operate as a balun even though there are no couplings in some parts of the transformer. In this case, the number of design parameters is reduced, resulting in a simplification in design.

For example, if there are no couplings between the first line and the third line and between the second line and the third line, the balun transformer satisfies a characteristic impedance condition expressed by the following equation:

$$\frac{1}{Z_{12}} = \frac{1}{Z_{33}} - \frac{1}{Z_{22}} = \sqrt{\frac{2}{Z_{0u}Z_{0b}}}$$

where, $z_{mn}$ (m,n=1,2,3) is a characteristic impedance between an mth line and an nth line, $Z_{0u}$ is a termination impedance of the unbalanced port, and $Z_{0b}$ is a termination impedance of each of the first and second balanced ports.

In addition, a bandwidth characteristic of the balun transformer can be adjusted by varying a parameter having no direct effect on the balun conditions, namely, a characteristic impedance $Z_{11}$ between the first line and the ground or a characteristic impedance $Z_{23}$ between the second line and the third line.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
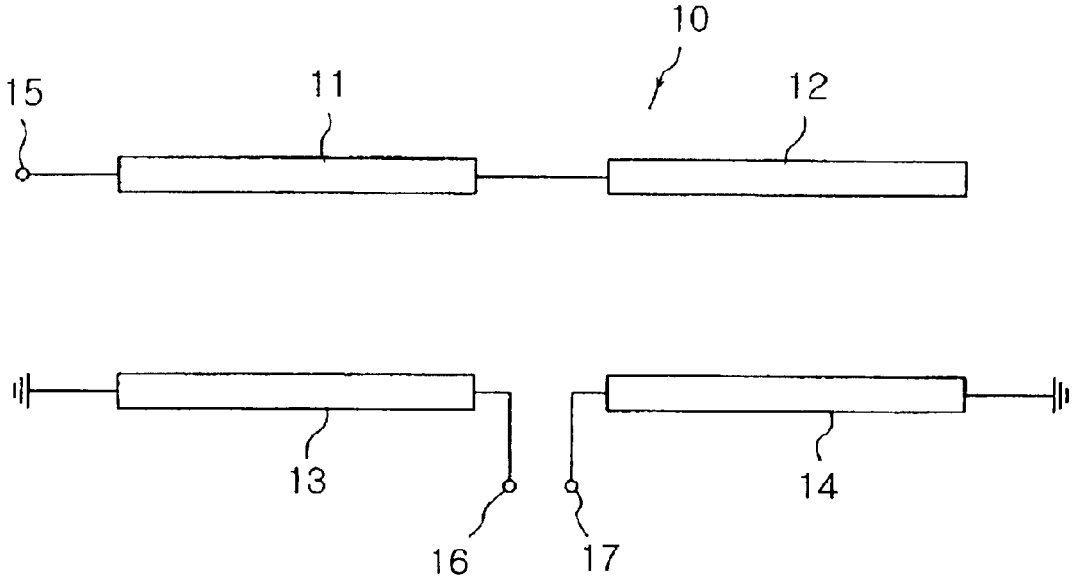
FIG. 1 PRIOR ART
FIG. 1 is an equivalent circuit diagram of a conventional balun transformer proposed by Marchand.
Figure 2:
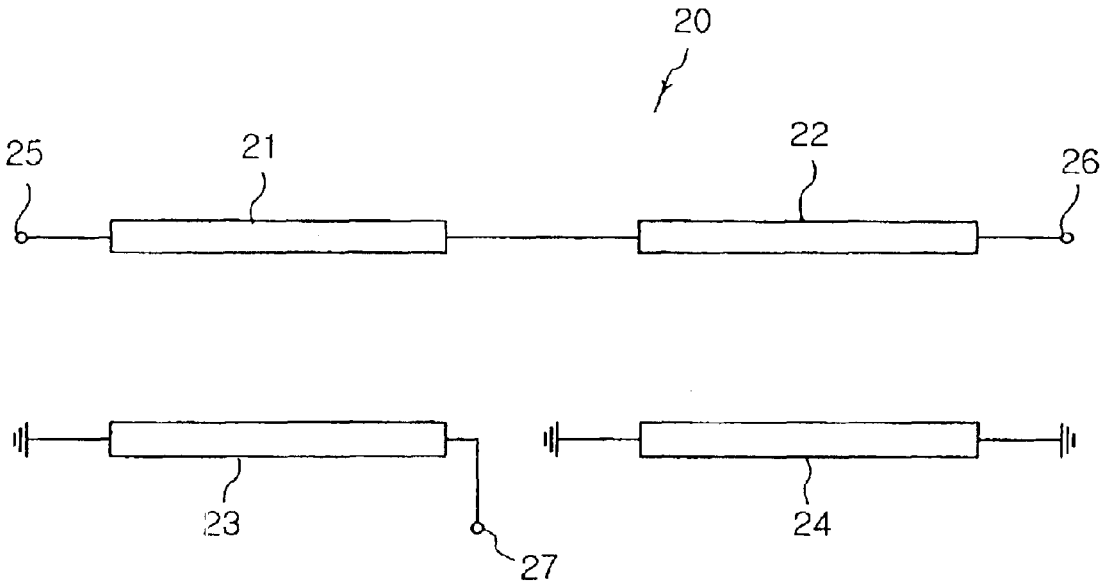
FIG. 2 PRIOR ART
FIG. 2 is an equivalent circuit diagram of another conventional balun transformer.
Figure 3:
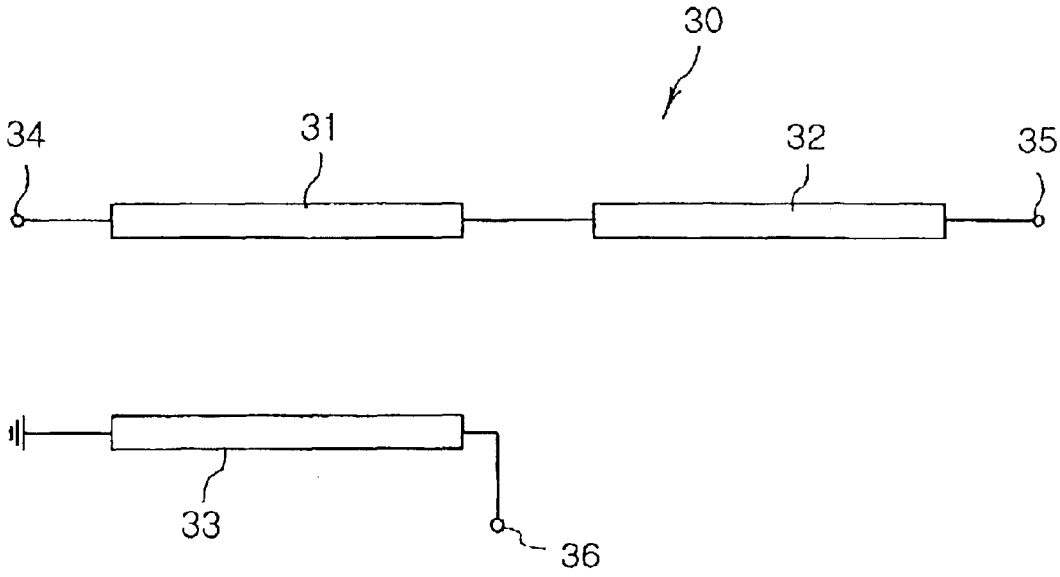
FIG. 3 PRIOR ART
FIG. 3 is an equivalent circuit diagram of another conventional balun transformer.
Figure 4:
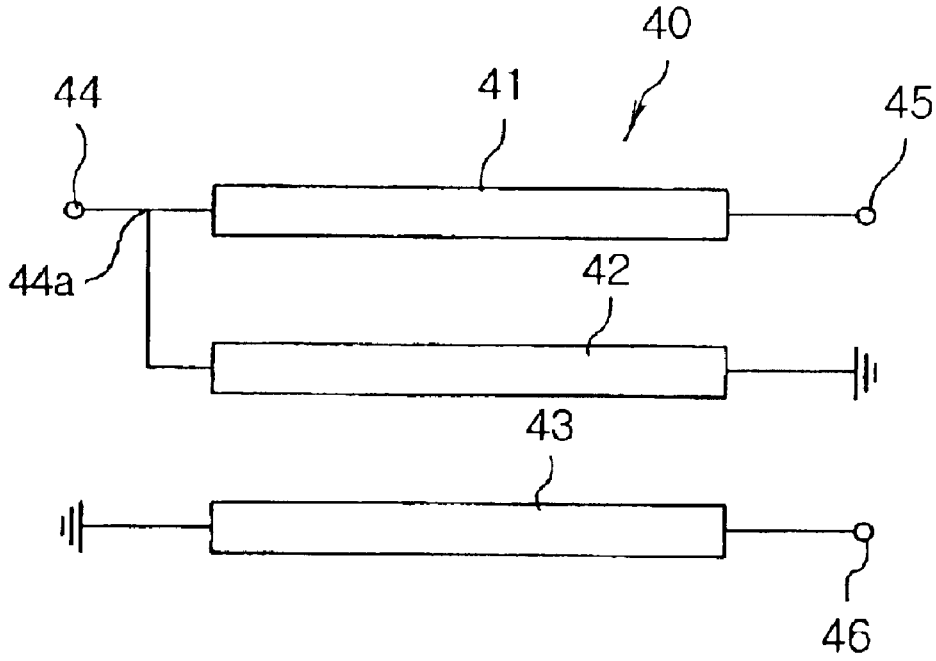
FIG. 4 PRIOR ART
FIG. 4 is an equivalent circuit diagram of yet another conventional balun transformer.
Figure 5:
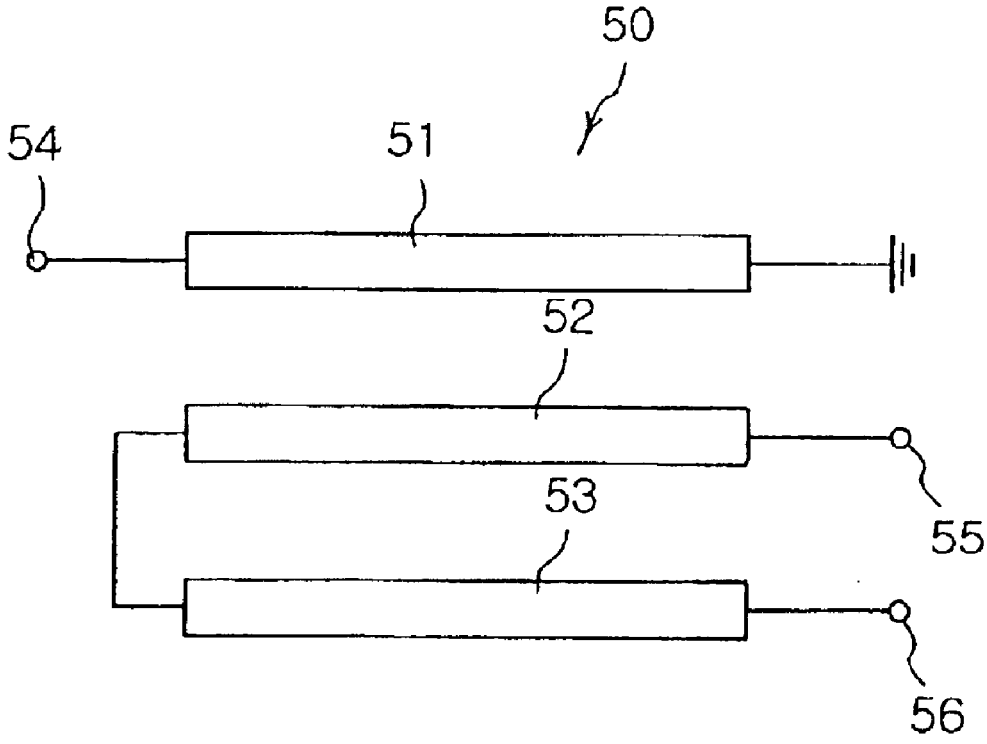
FIG. 5 is an equivalent circuit diagram of a 3-line balun transformer in accordance with the present invention.

FIG. 5 is an equivalent circuit diagram of a 3-line balun transformer in accordance with the present invention, which is denoted by the reference numeral 50. As shown in this drawing, the balun transformer 50 comprises first to third lines 51~53, each having first and second ends. The first to third lines 51~53 are arranged in such a manner that they are mutually electromagnetically coupled. The first end of the first line 51 is connected to an unbalanced port 54 for input or output of an unbalanced signal and the second end thereof is connected to ground. The first ends of the second line 52 and third line 53 are connected to each other and the second ends thereof are connected respectively to first and second balanced ports 55 and 56 for output or input of signals which are the same in level and 180 degrees out of phase with each other, respectively.

The first to third lines 51~53 are arranged in parallel to generate mutual electromagnetic couplings. That is, the first to third lines 51~53 form inter-line couplers.

If an unbalanced signal of a predetermined frequency is applied to the unbalanced port 54, then electromagnetic couplings and reflections occur among the first to third lines 51~53, thereby causing the first and second balanced ports 55 and 56 to output signals which are the same in level and 180 degrees out of phase with each other, respectively. That is, the balun transformer 50 converts an unbalanced signal into balanced signals.

To the contrary, if signals with the same levels and a phase difference of 180° therebetween are applied respectively to the first and second balanced ports 55 and 56, then an unbalanced signal is outputted from the unbalanced port 54. That is, the balun transformer 50 converts balanced signals into an unbalanced signal.

The operation of the balun transformer with the above-stated structure will hereinafter be mathematically described with reference to FIGS. 6*a* to 6*e*.

Figure 6A:
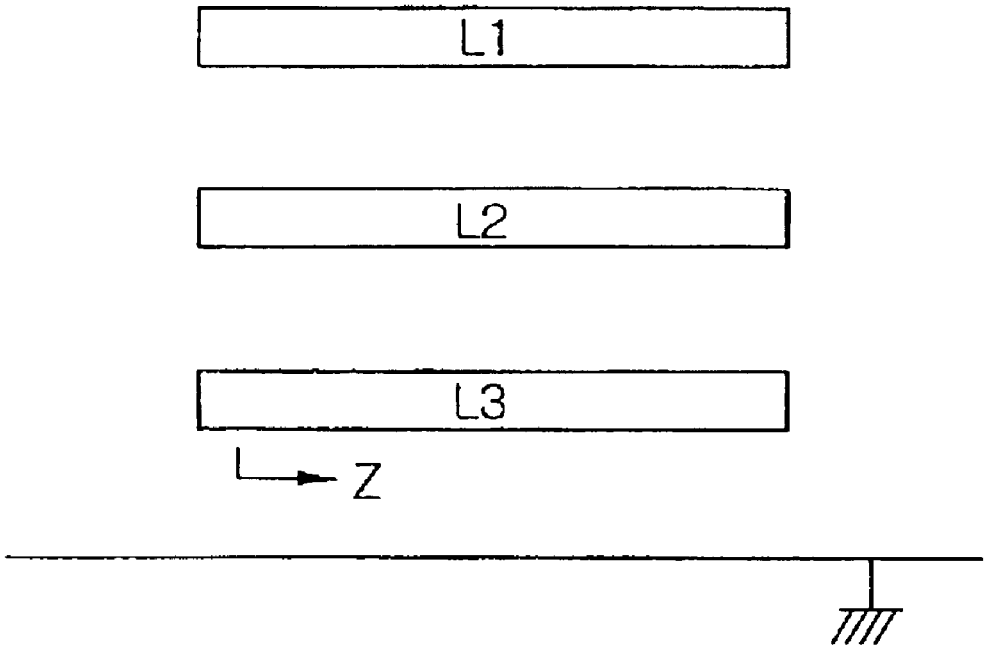
FIGS. 6*a* to 6*e* are views illustrating the operating principle of the 3-line balun transformer in accordance with the present invention.

If mutual couplings are made among three lines L1, L2 and L3 as shown in FIG. 6*a*, then a voltage and current of each of the lines can be expressed as a function of a position Z as in the following equation 1. Here, a reference direction of current is a +z direction.

$$\{V_L(z)\} = \begin{pmatrix} V_{L1}(z) \\ V_{L2}(z) \\ V_{L3}(z) \end{pmatrix} = \begin{bmatrix} A_1 & B_1 \\ A_2 & B_2 \\ A_3 & B_3 \end{bmatrix} \begin{pmatrix} e^{-j\beta z} \\ e^{j\beta z} \end{pmatrix} \quad \text{[Equation 1]}$$

$$\{I_L(z)\} = \begin{pmatrix} I_{L1}(z) \\ I_{L2}(z) \\ I_{L3}(z) \end{pmatrix} = \begin{bmatrix} y_{11} & y_{12} & y_{13} \\ y_{21} & y_{22} & y_{23} \\ y_{31} & y_{32} & y_{33} \end{bmatrix} \begin{bmatrix} A_1 & B_1 \\ A_2 & B_2 \\ A_3 & B_3 \end{bmatrix} \begin{pmatrix} e^{-j\beta z} \\ -e^{j\beta z} \end{pmatrix}$$

In the above equation 1, $A_1$, $A_2$ and $A_3$, and $B_1$, $B_2$ and $B_3$ are arbitrary constants determined depending on length and width boundary conditions of the lines L1, L2 and L3, respectively, and j is an imaginary unit with the property that $j^2=-1$. $\beta$ is a propagation constant defined by $\beta=2\pi/\lambda$ with respect to a wavelength $\lambda$.

Also, in the above equation 1, $V_{Li}(z)$ (here, i=1,2,3) represents a voltage of a line $L_i$ at the position z, and $I_{Li}(z)$ (here, i=1,2,3) represents current of the line $L_i$ at the position z.

Finally, in the above equation 1, $y_{11}$, $y_{12}$, $y_{13}$, $y_{21}$, $y_{22}$, $y_{23}$, $y_{31}$, $y_{32}$ and $y_{33}$ can be given as follows:

$$\begin{bmatrix} y_{11} & y_{12} & y_{13} \\ y_{21} & y_{22} & y_{23} \\ y_{31} & y_{32} & y_{33} \end{bmatrix} = \begin{bmatrix} \frac{1}{z_{11}} + \frac{1}{z_{12}} + \frac{1}{z_{13}} & -\frac{1}{z_{12}} & -\frac{1}{z_{13}} \\ -\frac{1}{z_{12}} & \frac{1}{z_{12}} + \frac{1}{z_{22}} + \frac{1}{z_{23}} & -\frac{1}{z_{23}} \\ -\frac{1}{z_{13}} & -\frac{1}{z_{23}} & \frac{1}{z_{13}} + \frac{1}{z_{23}} + \frac{1}{z_{33}} \end{bmatrix}$$

In the above equation, $z_{mn}$ (here, m,n=1,2,3, and m≠n) is a characteristic impedance formed by a coupling between two lines Lm and Ln, and $z_{mn}$ (here, m=1,2,3) is a characteristic impedance formed by a coupling between the line Lm and the ground.

Figure 6B:
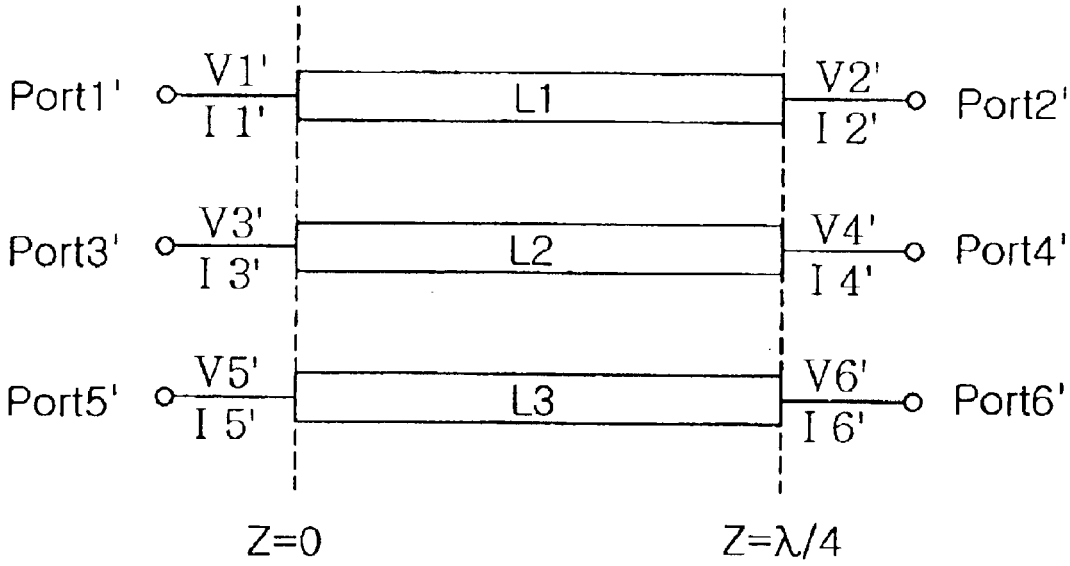

If, in the arrangement as shown in FIG. 6*a*, all the lines each have a length of ¼ of the wavelength at a center frequency and ports are configured as shown in FIG. 6*b*, then voltages $V_1'$, $V_3'$ and $V_5'$, and inrush currents $I_1'$, $I_3'$ and $I_5'$ at the left ports Port1', Port3' and Port5' can be defined respectively as in the following equations 2 and 3 under the condition that they are equal in level to voltages and currents of the respective lines at a position z=0:

$$\begin{pmatrix} V_1' \\ V_3' \\ V_5' \end{pmatrix} = \begin{pmatrix} V_{L1}(0) \\ V_{L2}(0) \\ V_{L3}(0) \end{pmatrix} = \begin{bmatrix} A_1 & B_1 \\ A_2 & B_2 \\ A_3 & B_3 \end{bmatrix} \begin{pmatrix} 1 \\ 1 \end{pmatrix} \quad \text{[Equation 2]}$$

$$\begin{pmatrix} I_1' \\ I_3' \\ I_5' \end{pmatrix} = \begin{pmatrix} I_{L1}(0) \\ I_{L2}(0) \\ I_{L3}(0) \end{pmatrix} \begin{bmatrix} y_{11} & y_{12} & y_{13} \\ y_{21} & y_{22} & y_{23} \\ y_{31} & y_{32} & y_{33} \end{bmatrix} \begin{bmatrix} A_1 & B_1 \\ A_2 & B_2 \\ A_3 & B_3 \end{bmatrix} \begin{pmatrix} 1 \\ -1 \end{pmatrix} \quad \text{[Equation 3]}$$

Voltages $V_2'$, $V_4'$ and $V_6'$ at the right ports Port2', Port4' and Port6' are equal in level to voltages of the respective lines at a position z=λ/4, and inrush currents $I_2'$, $I_4'$ and $I_6'$ thereat are equal in level to currents of the respective lines at the position z=λ/4, but opposite thereto in direction. Arranging these, the voltages $V_2'$, $V_4'$ and $V_6'$, and inrush currents $I_2'$, $I_4'$ and $I_6'$ at the right ports Port2', Port4' and Port6' can be defined as in the following equations 4 and 5, respectively:

$$\begin{pmatrix} V_2' \\ V_4' \\ V_6' \end{pmatrix} = \begin{pmatrix} V_{L1}(\lambda/4) \\ V_{L2}(\lambda/4) \\ V_{L3}(\lambda/4) \end{pmatrix} = \begin{bmatrix} A_1 & B_1 \\ A_2 & B_2 \\ A_3 & B_3 \end{bmatrix} \begin{pmatrix} -j \\ j \end{pmatrix} \quad \text{[Equation 4]}$$

$$\begin{pmatrix} I_2' \\ I_4' \\ I_6' \end{pmatrix} = \begin{pmatrix} I_{L1}(\lambda/4) \\ I_{L2}(\lambda/4) \\ I_{L3}(\lambda/4) \end{pmatrix} \begin{bmatrix} y_{11} & y_{12} & y_{13} \\ y_{21} & y_{22} & y_{23} \\ y_{31} & y_{32} & y_{33} \end{bmatrix} \begin{bmatrix} A_1 & B_1 \\ A_2 & B_2 \\ A_3 & B_3 \end{bmatrix} \begin{pmatrix} j \\ j \end{pmatrix} \quad \text{[Equation 5]}$$

Simplifying the above equation 4, the result is $$\begin{bmatrix} A_1 & B_1 \\ A_2 & B_2 \\ A_3 & B_3 \end{bmatrix} \begin{pmatrix} 1 \\ -1 \end{pmatrix} = j \begin{pmatrix} V_2' \\ V_4' \\ V_6' \end{pmatrix}.$$

Substituting the above equation 3 into that result, the result is:

$$\begin{pmatrix} I_1' \\ I_3' \\ I_5' \end{pmatrix} = j \begin{bmatrix} y_{11} & y_{12} & y_{13} \\ y_{21} & y_{22} & y_{23} \\ y_{31} & y_{32} & y_{33} \end{bmatrix} \begin{pmatrix} V_2' \\ V_4' \\ V_6' \end{pmatrix} \quad \text{[Equation 6]}$$

Transforming the above equation 5 similarly to the above manner, the result is $$\begin{pmatrix} I_2' \\ I_4' \\ I_6' \end{pmatrix} = j \begin{bmatrix} y_{11} & y_{12} & y_{13} \\ y_{21} & y_{22} & y_{23} \\ y_{31} & y_{32} & y_{33} \end{bmatrix} \begin{bmatrix} A_1 & B_1 \\ A_2 & B_2 \\ A_3 & B_3 \end{bmatrix} \begin{pmatrix} 1 \\ 1 \end{pmatrix}.$$

Substituting the above equation 2 into that result, the result is:

$$\begin{pmatrix} I_2' \\ I_4' \\ I_6' \end{pmatrix} = j \begin{bmatrix} y_{11} & y_{12} & y_{13} \\ y_{21} & y_{22} & y_{23} \\ y_{31} & y_{32} & y_{33} \end{bmatrix} \begin{pmatrix} V_1' \\ V_3' \\ V_5' \end{pmatrix} \quad \text{[Equation 7]}$$

Figure 6C:
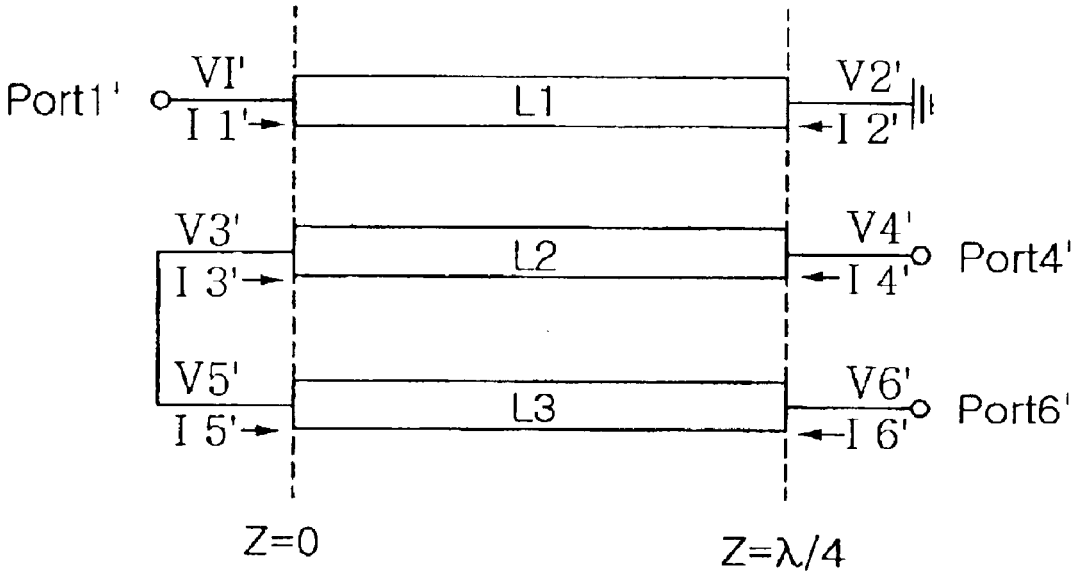

Next, if, in the structure of FIG. 6*b*, the right port Port2' of the line L1 is connected to the ground such that it is short-circuited, and the left ports Port3' and Port5' of the other lines L2 and L3 are connected to each other, then the resulting structure is obtained as shown in FIG. 6*c*.

In the structure as shown in FIG. 6*c*, boundary conditions, namely, $V_2'=0$, $V_3'=V_5'$, and $I_3'+I_5'=0$ are established among the voltages and currents of the respective ports.

Substituting these conditions into the above equation 6 and equation 7, the result is:

$$\begin{pmatrix} I_1' \\ I_3' \\ -I_3' \end{pmatrix} = j \begin{bmatrix} y_{11} & y_{12} & y_{13} \\ y_{21} & y_{22} & y_{23} \\ y_{31} & y_{32} & y_{33} \end{bmatrix} \begin{pmatrix} 0 \\ V_4' \\ V_6' \end{pmatrix}, \quad \text{[Equation 8]}$$

$$\begin{pmatrix} I_2' \\ I_3' \\ I_6' \end{pmatrix} = j \begin{bmatrix} y_{11} & y_{12} & y_{13} \\ y_{21} & y_{22} & y_{23} \\ y_{31} & y_{32} & y_{33} \end{bmatrix} \begin{pmatrix} V_1' \\ V_3' \\ V_3' \end{pmatrix}$$

Figure 6D:
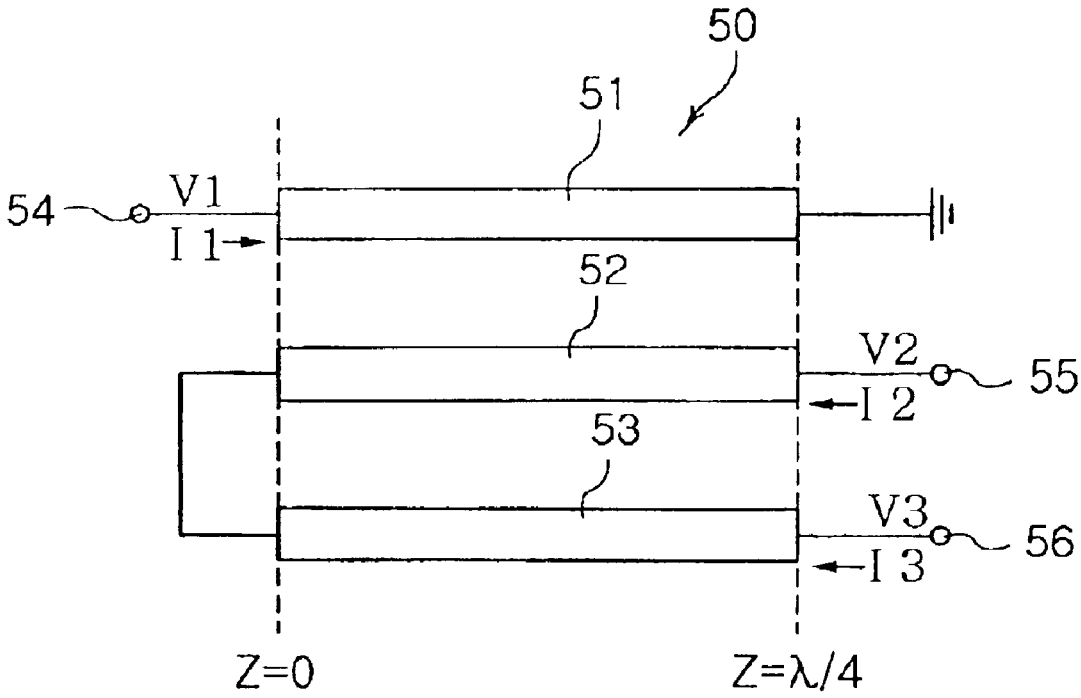

If, in the structure of FIG. 6*c*, the respective ports are rearranged as shown in FIG. 6*d* in such a manner that the port Port1' is corrected into the unbalanced port 54, the port Port4' into the first balanced port 55 and the port Port6' into the second balanced port 56, respectively, and the current $I_3'$ and voltage $V_3'$ are removed, then the relation between currents $I_1$, $I_2$ and $I_3$ and voltages $V_1$, $V_2$ and $V_3$ at the respective ports can be defined as in the following equation 9:

$$\begin{pmatrix} V_1 \\ V_2 \\ V_3 \end{pmatrix} = [z] \begin{pmatrix} I_1 \\ I_2 \\ I_3 \end{pmatrix} = \begin{bmatrix} 0 & G_{12} & G_{13} \\ G_{12} & 0 & 0 \\ G_{13} & 0 & 0 \end{bmatrix} \begin{pmatrix} I_1 \\ I_2 \\ I_3 \end{pmatrix} \quad \text{[Equation 9]}$$

In the above equation 9, $$G_{12} = \frac{-j(y_{23} + y_{33})}{y_{12}(y_{23} + y_{33}) - y_{13}(y_{22} + y_{23})}, \quad \text{and}$$

$$G_{13} = \frac{j(y_{22} + y_{33})}{y_{12}(y_{23} + y_{33}) - y_{13}(y_{22} + y_{23})}.$$

Generally, an impedance parameter matrix [Z] indicative of the voltage/current relation at the ports can be transformed into a scattering parameter matrix [S] signifying the relation between incident power and reflected power, as in the below equation 10:

$$[S] = [Z_{tr}]^{-1}([Z] - [Z_t])([Z] + [Z_t])^{-1}[Z_{tr}] \quad \text{[Equation 10]}$$

$$[z_t] = \begin{bmatrix} Z_{01} & 0 & 0 \\ 0 & Z_{02} & 0 \\ 0 & 0 & Z_{03} \end{bmatrix}$$

$$[z_{tr}] = \begin{bmatrix} \sqrt{Z_{01}} & 0 & 0 \\ 0 & \sqrt{Z_{02}} & 0 \\ 0 & 0 & \sqrt{Z_{03}} \end{bmatrix}$$

In the above equation 10, $Z_{01}$ is a termination impedance of the unbalanced port 54, $Z_{02}$ is a termination impedance of the first balanced port 55, and $Z_{03}$ is a termination impedance of the second balanced port 56.

Thus, letting $Z_{01}=Z_{0u}$ and $Z_{02}=Z_{03}=Z_{0b}$, and utilizing the above equation 10 and equation 9, [S] can be obtained as follows:

$$[S] = \begin{bmatrix} S_{11} & S_{12} & S_{13} \\ S_{21} & S_{22} & S_{23} \\ S_{31} & S_{32} & S_{33} \end{bmatrix} = \frac{1}{D}\begin{bmatrix} -Z_{0u}Z_{0b} - G_{12}^2 - G_{13}^2 & 2\sqrt{Z_{0u}Z_{0b}}\,G_{12} & 2\sqrt{Z_{0u}Z_{0b}}\,G_{13} \\ 2\sqrt{Z_{0u}Z_{0b}}\,G_{12} & -Z_{0u}Z_{0b} - G_{12}^2 + G_{13}^2 & -2\sqrt{Z_{0u}Z_{0b}}\,G_{12}G_{13} \\ 2\sqrt{Z_{0u}Z_{0b}}\,G_{13} & -2\sqrt{Z_{0u}Z_{0b}}\,G_{12}G_{13} & -Z_{0u}Z_{0b} + G_{12}^2 - G_{13}^2 \end{bmatrix}$$

$$D=Z_{0u}Z_{0b}-G_{12}^2-G_{13}^2$$

In the above equation, the transformer must satisfy conditions of $S_{11}=0$, and $S_{21}=-S_{31}$ in order to operate as a balun.

Conditions satisfying such conditions are $G_{12}=-G_{13}$, and $G_{12}^2+G_{13}^2=-Z_{0in}Z_{0out}$.

Thus, obtaining the above satisfying conditions from the above equation 9, the result is:

$$y_{22}=y_{33}$$

$$y_{12} - y_{13} = \pm\sqrt{\frac{2}{Z_{0in}Z_{0out}}}$$

A characteristic impedance condition satisfying the above satisfying conditions can be expressed as in the below equation 11:

$$\frac{1}{Z_{13}} - \frac{1}{Z_{12}} = \frac{1}{Z_{22}} - \frac{1}{Z_{33}} = \pm\sqrt{\frac{2}{Z_{0u}Z_{0b}}} \quad \text{[Equation 11]}$$

That is, the transformer can operate as a balun only when the three lines 51~53 of the lengths of $\lambda/4$, configured as shown in FIG. 6*d*, have characteristic impedances satisfying the above equation 11.

As demonstrated by the above equation 11, there are many adjustable parameters in designing the balun transformer 50, which signifies that the transformer can be designed in more various ways at a design stage.

In addition, not all couplings among the three lines 51~53 and all couplings between the lines 51~53 and the ground need to exist in order to enable the transformer to operate as a balun. Conditions can be found which enable the transformer to operate as a balun even though there are no couplings in some parts of the transformer.

In the above description, the absence of a coupling signifies that a characteristic impedance corresponding thereto is infinite.

For example, in the balun transformer, a characteristic impedance $Z_{11}$ between the first line 51 and the ground may be set to infinity such that there is no coupling therebetween. Alternatively, a characteristic impedance $Z_{23}$ between the second line 52 and the third line 53 may be set to infinity. Or, the characteristic impedance between the first line 51 and the ground and the characteristic impedance between the second line 52 and the third line 53 may be both set to infinity, namely, $Z_{11}\rightarrow\infty$ and $Z_{23}\rightarrow\infty$. In this case, an impedance condition for enabling the transformer to function as a balun is the same as that of the above equation 11, but a different passband width is given.

As an alternative, the characteristic impedance $Z_{12}$ between the first line 51 and the second line 52 may be set to infinity such that there is no coupling therebetween. Alternatively, the characteristic impedance between the first line 51 and the second line 52 and the characteristic impedance between the first line 51 and the ground may be both set to infinity, namely, $Z_{12}\rightarrow\infty$ and $Z_{11}\rightarrow\infty$ such that there are no couplings between the first line 51 and the second line 52 and between the first line 51 and the ground. Or, the characteristic impedance between the first line 51 and the second line 52 and the characteristic impedance between the second line 52 and the third line 53 may be both set to infinity, namely, $Z_{12}\rightarrow\infty$ and $Z_{23}\rightarrow\infty$. Or, the characteristic impedance between the first line 51 and the second line 52, the characteristic impedance between the first line 51 and the ground and the characteristic impedance between the second line 52 and the third line 53 may be all set to infinity, namely, $Z_{12}\rightarrow\infty$, $Z_{11}\rightarrow\infty$ and $Z_{23}\rightarrow\infty$. In this case, an impedance condition of the balun transformer is $$\frac{1}{Z_{13}} = \frac{1}{Z_{22}} - \frac{1}{Z_{33}} = \sqrt{\frac{2}{Z_{0u}Z_{0b}}}.$$

As another alternative, at least one of the characteristic impedance $Z_{13}$ between the first line 51 and the third line 53, the characteristic impedance $Z_{11}$ between the first line 51 and the ground and the characteristic impedance $Z_{23}$ between the second line 52 and the third line 53 may be set to infinity. In this case, an impedance condition of the balun transformer is $$\frac{1}{Z_{12}} = \frac{1}{Z_{33}} - \frac{1}{Z_{22}} = \sqrt{\frac{2}{Z_{0u}Z_{0b}}}.$$

In another embodiment, at least one of the characteristic impedance $Z_{22}$ between the second line 52 and the ground, the characteristic impedance $Z_{11}$, between the first line 51 and the ground and the characteristic impedance $Z_{23}$ between the second line 52 and the third line 53 may be set to infinity. In this case, an impedance condition of the balun transformer is $$\frac{1}{Z_{13}} - \frac{1}{Z_{12}} = -\frac{1}{Z_{33}} = -\sqrt{\frac{2}{Z_{0u}Z_{0b}}}.$$

In another embodiment, at least one of the characteristic impedance $Z_{33}$ between the third line 53 and the ground, the characteristic impedance $Z_{11}$ between the first line 51 and the ground and the characteristic impedance $Z_{23}$ between the second line 52 and the third line 53 may be set to infinity.

In this case, an impedance condition for enabling the transformer to operate as a balun is $$\frac{1}{Z_{13}} - \frac{1}{Z_{12}} = \frac{1}{Z_{22}} = \sqrt{\frac{2}{Z_{0u}Z_{0b}}}.$$

Alternatively, the characteristic impedance $Z_{12}$ between the first line 51 and the second line 52 and the characteristic impedance $Z_{33}$ between the third line 53 and the ground may be both set to infinity such that there are no couplings between the first line 51 and the second line 52 and between the third line 53 and the ground. In this case, an impedance condition for enabling the transformer to operate as a balun is $$\frac{1}{Z_{13}} = \frac{1}{Z_{22}} = \sqrt{\frac{2}{Z_{0u}Z_{0b}}}.$$

In addition to this impedance condition, the characteristic impedance $Z_{11}$ between the first line 51 and the ground and the characteristic impedance $Z_{23}$ between the second line 52 and the third line 53 may be both set to infinity. In this case, the impedance condition is subject to no variation, but a different passband characteristic is given.

In another embodiment, the characteristic impedance $Z_{13}$ between the first line 51 and the third line 53 and the characteristic impedance $Z_{22}$ between the second line 52 and the ground may be both set to infinity such that there are no couplings between the first line 51 and the third line 53 and between the second line 52 and the ground. In this case, an impedance condition for enabling the transformer to operate as a balun is $$-\frac{1}{Z_{12}} = -\frac{1}{Z_{33}} = -\sqrt{\frac{2}{Z_{0u}Z_{0b}}}.$$

Satisfying this impedance condition, the transformer can operate as a balun. Besides, in addition to this impedance condition, the characteristic impedance $Z_{11}$ between the first line 51 and the ground and the characteristic impedance $Z_{23}$ between the second line 52 and the third line 53 may be both set to infinity. In this case, the balun conditions are subject to no effect, but an adjusted passband width is given.

As described above, according to the present invention, no couplings may be present in some parts of the transformer, thereby making it possible to reduce the number of parameters in the characteristic impedance condition of the equation 11 and thus facilitate the designing of the transformer.

Figure 6E:
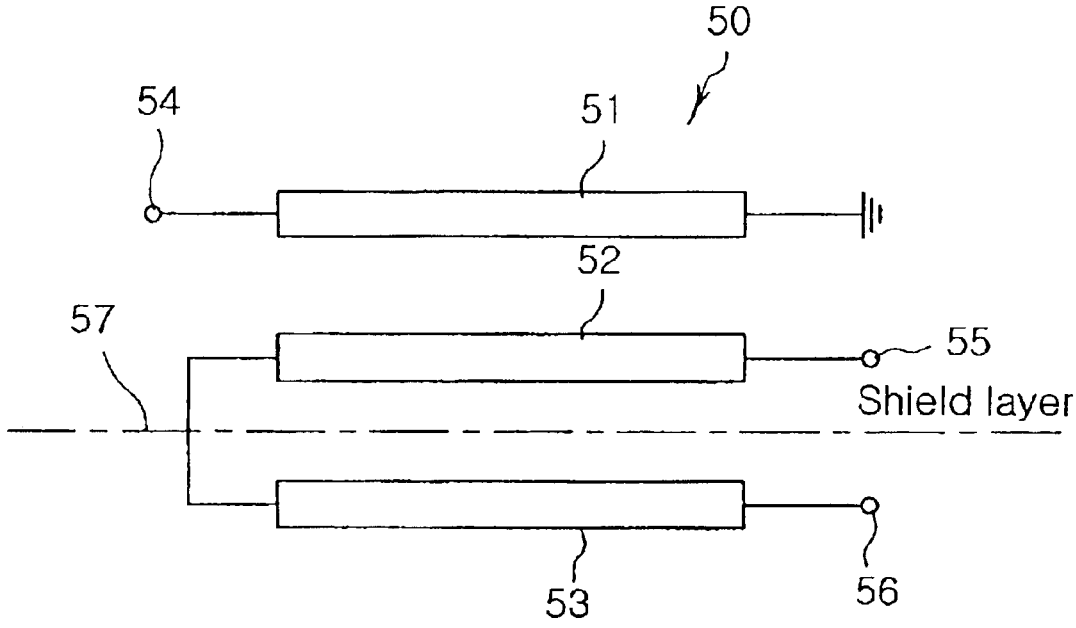

FIG. 6*e* shows the structure of the balun transformer with no couplings between the first line 51 and the third line 53 and between the second line 52 and the third line 53, among the above-described embodiments. In this structure, a shield is used to prevent couplings from occurring between the first and second lines 51 and 52 and the third line 53. However, the present invention is not limited thereto, and may use any other methods than the shield to remove couplings.

Figure 7:
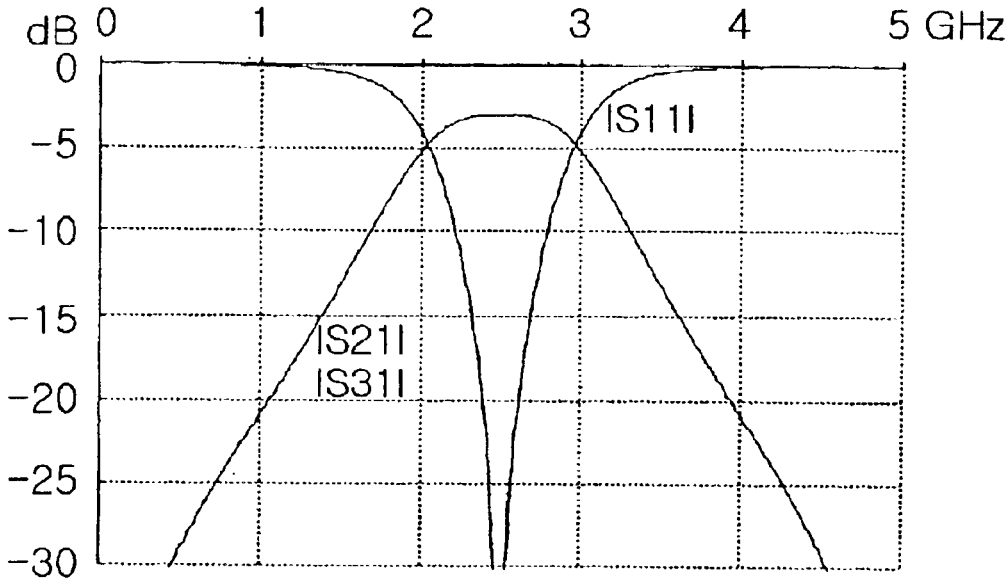
FIG. 7 is a graph showing the results of a simulation of the balun transformer in accordance with the present invention.

FIG. 7 is a graph showing the results of a simulation of the balun transformer in accordance with the present invention, wherein the characteristic impedances in the structure of FIG. 6*d* are set as follows: $Z_{11}$=50Ω, $Z_{22}$=50Ω, $Z_{33}$=20.71Ω, $Z_{12}$=20.71Ω, $Z_{13}$=50Ω, and $Z_{23}$=50Ω.

Figure 8:
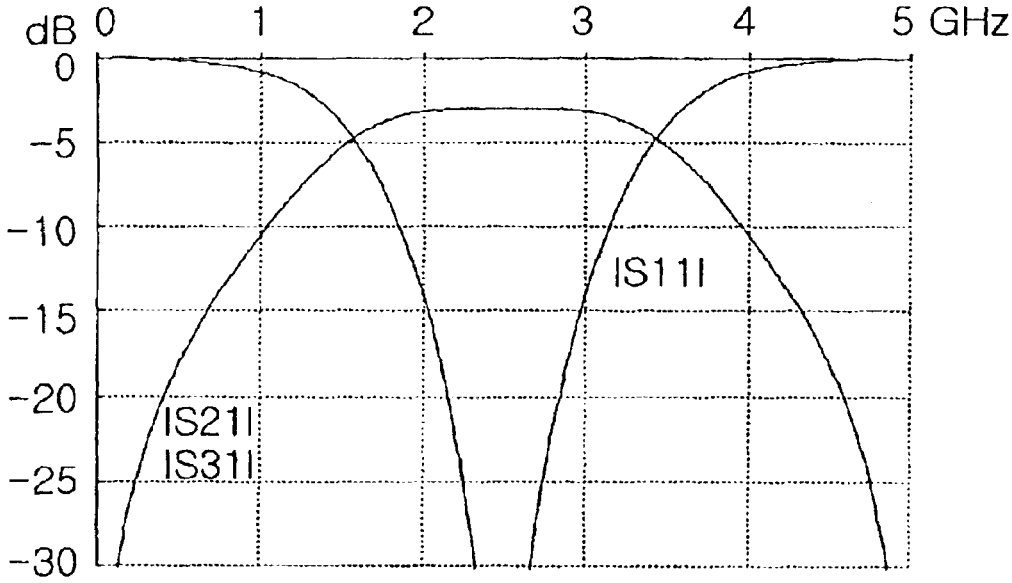
FIG. 8 is a graph showing the results of another simulation of the balun transformer in accordance with the present invention.

FIG. 8 is a graph showing the results of another simulation of the balun transformer in accordance with the present invention, wherein the characteristic impedances in the structure of FIG. 6*d* (that is, there are no couplings between the first line 51 and the third line 53 and between the second line 52 and the third line 53) are set as follows: $Z_{11}$=50Ω, $Z_{22}$=50Ω, $Z_{33}$=20.71Ω, and $Z_{12}$=35.36Ω.

It can be seen from the simulation results of FIGS. 7 and 8 that the transformer satisfies desired balun characteristics even though the couplings of the first to third lines 51~53 are partially removed.

From the above characteristic impedance condition, it is seen that $Z_{11}$=$Z_{22}$, so the couplers are in symmetrical relation.

Figure 9:
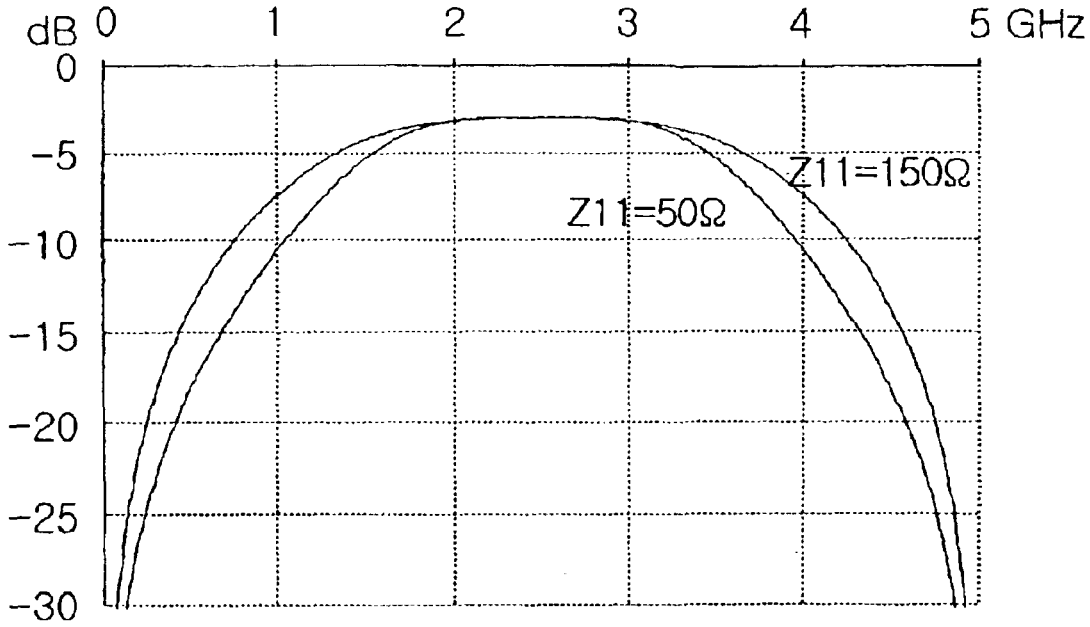
FIG. 9 is a graph showing a comparison between the results of the simulation of FIG. 8 and the results of a simulation having a different characteristic impedance condition from that in the simulation of FIG. 8.

FIG. 9 is a graph showing a comparison between the results of the simulation of FIG. 8 and the results of a simulation where the characteristic impedance $Z_{11}$ between the first line 51 and the ground is changed from 50Ω in FIG. 8 to 150Ω under the condition that the other impedances have the same values as those in FIG. 8. As seen from this comparison of FIG. 9, in the case where the couplers in the balun transformer with the above-stated structure are in asymmetrical relation, not limited to the symmetrical relation, a signal bandwidth characteristic can be improved by fixing the parameters $Z_{22}$, $Z_{33}$ and $Z_{12}$ affecting the balun conditions and varying the parameter $Z_{11}$ having no direct effect thereon.

Figure 10:
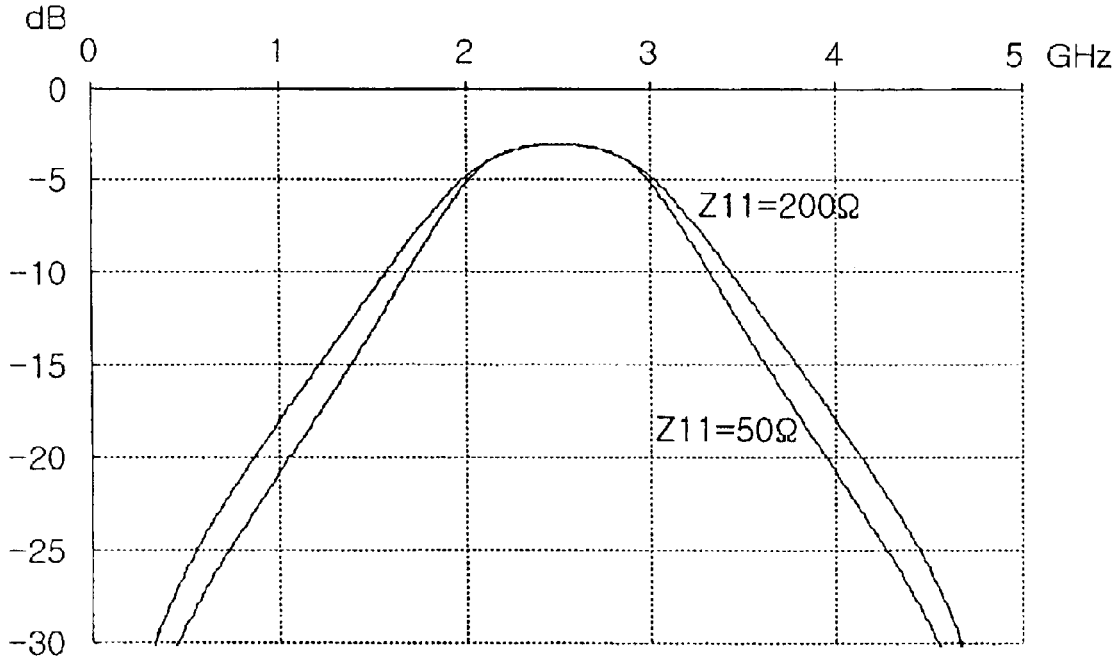
FIG. 10 is a graph showing a comparison between the results of the simulation of FIG. 7 and the results of a simulation having a different characteristic impedance condition from that in the simulation of FIG. 7.

FIG. 10 is a graph showing a balun characteristic variation with a variation in the parameter $Z_{11}$ having no effect on the balun conditions, that is, shapes of $|S_{21}|$ or $|S_{31}|$ of the balun transformer structure with $Z_{11}$=50Ω, $Z_{22}$=50Ω, $Z_{33}$=20.71Ω, $Z_{12}$=20.71Ω, $Z_{13}$=50Ω and $Z_{23}$=50Ω and the balun transformer structure with $Z_{11}$=200Ω, $Z_{22}$=50Ω, $Z_{33}$=20.71Ω, $Z_{12}$=20.71Ω, $Z_{13}$=50Ω and $Z_{23}$=50Ω.

Figure 11:
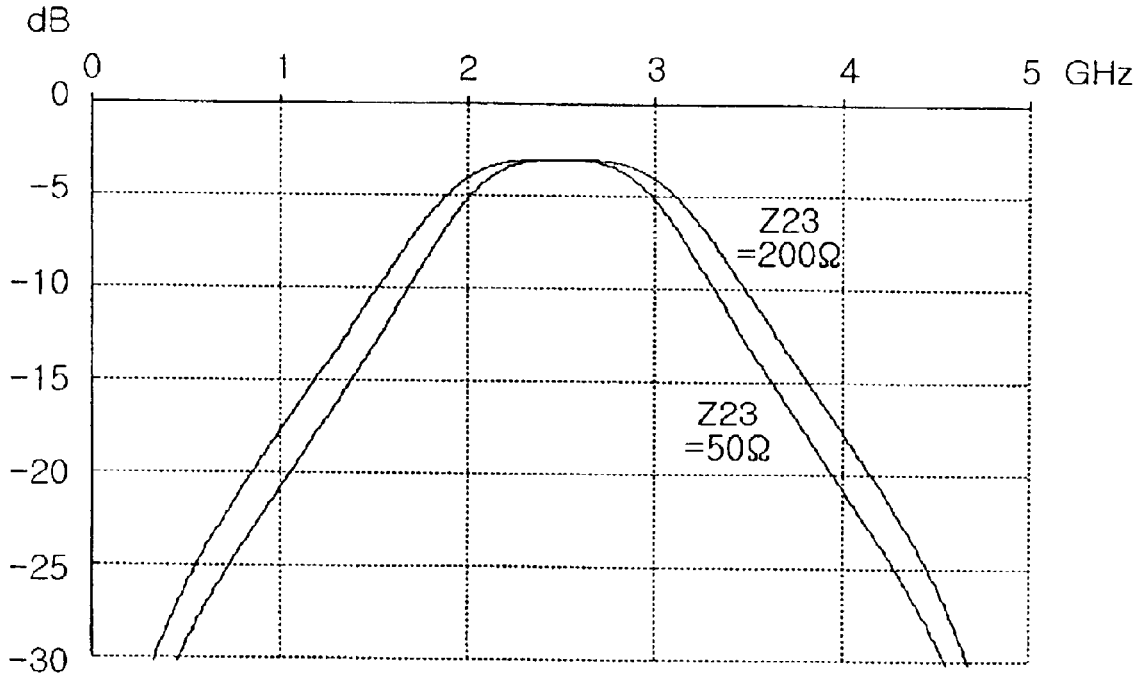
FIG. 11 is a graph showing a comparison between the results of the simulation of FIG. 7 and the results of another simulation having a different characteristic impedance condition from that in the simulation of FIG. 7.

FIG. 11 is a graph showing a balun characteristic variation with a variation in the characteristic impedance $Z_{23}$ between the second line 52 and the third line 53, that is, shapes of $|S_{21}|$ or $|S_{31}|$ of the balun transformer structure with $Z_{11}$=50Ω, $Z_{22}$=50Ω, $Z_{33}$=20.71Ω, $Z_{12}$=20.71Ω, $Z_{13}$=50Ω and $Z_{23}$=50Ω and the balun transformer structure with $Z_{11}$=50Ω, $Z_{22}$=50Ω, $Z_{33}$=20.71Ω, $Z_{12}$=20.71Ω, $Z_{13}$=50Ω and $Z_{23}$=200Ω.

It can be seen from the comparison between the results of FIG. 10 and the results of FIG. 11 that the passband width of the balun transformer can be varied by varying the parameter $Z_{11}$ or $Z_{23}$ having no effect on the balun conditions.

As apparent from the above description, the present invention provides a balun transformer which is implemented with three lines, each having a length of λ/4. In this balun transformer, the number of ground ports is reduced, resulting in a simplification in structure and, in turn, an advantage in terms of miniaturization.

In addition, the present balun transformer has no branching point for input and output signals, provided in a conventional 3-line balun transformer, thereby making the entire structure simpler and facilitating the manufacture of the transformer.

Furthermore, couplers are not limited to a symmetrical structure or asymmetrical structure, leading to an advantage in terms of design. In particular, in the case where the couplers have the asymmetrical structure, a bandwidth characteristic of the balun transformer can be improved with no effect on balun conditions.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A 3-line balun transformer comprising:

an unbalanced port for inputting or outputting an unbalanced signal;

first and second balanced ports for outputting or inputting balanced signals, respectively, said balanced signals being the same in level and 180 degrees out of phase with each other;

a first line having a first end connected to said unbalanced port and a second end connected to ground;

a second line arranged in parallel with said first line while being spaced apart from said first line by a predetermined distance, said second line having a first end and a second end, the second end of second line being connected to said first balanced port; and a third line arranged in parallel with said second line while being spaced apart from said second line by a predetermined distance, said third line having a first end connected to said first end of said second line and a second end connected to said second balanced port.

2. The 3-line balun transformer as set forth in claim 1, wherein said first, second and third lines each have a length of $\lambda/4$ ($\lambda$ is a wavelength at a center frequency of an input/output signal).

3. The 3-line balun transformer as set forth in claim 1, wherein said transformer satisfies an impedance condition expressed by the following equation:

$$\frac{1}{Z_{13}} - \frac{1}{Z_{12}} = \frac{1}{Z_{22}} - \frac{1}{Z_{33}} = \pm\sqrt{\frac{2}{Z_{0u}Z_{0b}}}$$

where, $z_{mn}$ (m,n=1,2,3) is a characteristic impedance between an mth line and an nth line, $Z_{0u}$ is a termination impedance of said unbalanced port, and $Z_{0b}$ is a termination impedance of each of said first and second balanced ports.

4. The 3-line balun transformer as set forth in claim 3, wherein a characteristic impedance $Z_{11}$ between said first line and said ground is infinite.

5. The 3-line balun transformer as set forth in claim 3, wherein a characteristic impedance $Z_{23}$ between said second line and said third line is infinite.

6. The 3-line balun transformer as set forth in claim 3, wherein a characteristic impedance $Z_{11}$ between said first line and said ground is infinite and a characteristic impedance $Z_{23}$ between said second line and said third line is infinite.

7. The 3-line balun transformer as set forth in claim 3, wherein the characteristic impedance $Z_{12}$ between said first line and said second line is infinite.

8. The 3-line balun transformer as set forth in claim 3, wherein the characteristic impedance $Z_{12}$ between said first line and said second line is infinite and a characteristic impedance $Z_{11}$ between said first line and said ground is infinite.

9. The 3-line balun transformer as set forth in claim 3, wherein the characteristic impedance $Z_{12}$ between said first line and said second line is infinite and a characteristic impedance $Z_{23}$ between said second line and said third line is infinite.

10. The 3-line balun transformer as set forth in claim 3, wherein the characteristic impedance $Z_{12}$ between said first line and said second line is infinite, a characteristic impedance $Z_{11}$ between said first line and said ground is infinite, and a characteristic impedance $Z_{23}$ between said second line and said third line is infinite.

11. The 3-line balun transformer as set forth in claim 3, wherein the characteristic impedance $Z_{13}$ between said first line and said third line is infinite.

12. The 3-line balun transformer as set forth in claim 3, wherein the characteristic impedance $Z_{13}$ between said first line and said third line is infinite and a characteristic impedance $Z_{11}$ between said first line and said ground is infinite.

13. The 3-line balun transformer as set forth in claim 3, wherein the characteristic impedance $Z_{13}$ between said first line and said third line is infinite and a characteristic impedance $Z_{23}$ between said second line and said third line is infinite.

14. The 3-line balun transformer as set forth in claim 3, wherein the characteristic impedance $Z_{13}$ between said first line and said third line is infinite, a characteristic impedance $Z_{11}$ between said first line and said ground is infinite, and a characteristic impedance $Z_{23}$ between said second line and said third line is infinite.

15. The 3-line balun transformer as set forth in claim 3, wherein the characteristic impedance $Z_{22}$ between said second line and said ground is infinite.

16. The 3-line balun transformer as set forth in claim 3, wherein the characteristic impedance $Z_{22}$ between said second line and said ground is infinite and a characteristic impedance $Z_{11}$ between said first line and said ground is infinite.

17. The 3-line balun transformer as set forth in claim 3, wherein the characteristic impedance $Z_{22}$ between said second line and said ground is infinite and a characteristic impedance $Z_{23}$ between said second line and said third line is infinite.

18. The 3-line balun transformer as set forth in claim 3, wherein the characteristic impedance $Z_{22}$ between said second line and said ground is infinite, a characteristic impedance $Z_{11}$ between said first line and said ground is infinite, and a characteristic impedance $Z_{23}$ between said second line and said third line is infinite.

19. The 3-line balun transformer as set forth in claim 3, wherein the characteristic impedance $Z_{33}$ between said third line and said ground is infinite.

20. The 3-line balun transformer as set forth in claim 3, wherein the characteristic impedance $Z_{33}$ between said third line and said ground is infinite and a characteristic impedance $Z_{11}$ between said first line and said ground is infinite.

21. The 3-line balun transformer as set forth in claim 3, wherein the characteristic impedance $Z_{33}$ between said third line and said ground is infinite and a characteristic impedance $Z_{23}$ between said second line and said third line is infinite.

22. The 3-line balun transformer as set forth in claim 3, wherein the characteristic impedance $Z_{33}$ between said third line and said ground is infinite, a characteristic impedance $Z_{11}$ between said first line and said ground is infinite, and a characteristic impedance $Z_{23}$ between said second line and said third line is infinite.

23. The 3-line balun transformer as set forth in claim 3, wherein the characteristic impedance $Z_{12}$ between said first line and said second line is infinite and the characteristic impedance $Z_{33}$ between said third line and said ground is infinite.

24. The 3-line balun transformer as set forth in claim 3, wherein the characteristic impedance $Z_{12}$ between said first line and said second line is infinite, the characteristic impedance $Z_{33}$ between said third line and said ground is infinite, and a characteristic impedance $Z_{11}$ between said first line and said ground is infinite.

25. The 3-line balun transformer as set forth in claim 3, wherein the characteristic impedance $Z_{12}$ between said first line and said second line is infinite, the characteristic impedance $Z_{33}$ between said third line and said ground is infinite, and a characteristic impedance $Z_{23}$ between said second line and said third line is infinite.

26. The 3-line balun transformer as set forth in claim 3, wherein the characteristic impedance $Z_{12}$ between said first line and said second line is infinite, the characteristic impedance $Z_{33}$ between said third line and said ground is infinite, a characteristic impedance $Z_{11}$ between said first line and said ground is infinite, and a characteristic impedance $Z_{23}$ between said second line and said third line is infinite.

27. The 3-line balun transformer as set forth in claim 3, wherein the characteristic impedance $Z_{13}$ between said first line and said third line is infinite and the characteristic impedance $Z_{22}$ between said second line and said ground is infinite.

28. The 3-line balun transformer as set forth in claim 3, wherein the characteristic impedance $Z_{13}$ between said first line and said third line is infinite, the characteristic impedance $Z_{22}$ between said second line and said ground is infinite, and a characteristic impedance $Z_{11}$ between said first line and said ground is infinite.

29. The 3-line balun transformer as set forth in claim 3, wherein the characteristic impedance $Z_{13}$ between said first line and said third line is infinite, the characteristic impedance $Z_{22}$ between said second line and said ground is infinite, and a characteristic impedance $Z_{23}$ between said second line and said third line is infinite.

30. The 3-line balun transformer as set forth in claim 3, wherein the characteristic impedance $Z_{13}$ between said first line and said third line is infinite, the characteristic impedance $Z_{22}$ between said second line and said ground is infinite, a characteristic impedance $Z_{11}$ between said first line and said ground is infinite, and a characteristic impedance $Z_{23}$ between said second line and said third line is infinite.

31. The 3-line balun transformer as set forth in claim 3, wherein a bandwidth characteristic is adjusted by varying a characteristic impedance $Z_{11}$ between said first line and said ground or a characteristic impedance $Z_{23}$ between said second line and said third line.

32. A 3-line balun transformer comprising:

an unbalanced port for inputting or outputting an unbalanced signal;

first and second balanced ports for outputting or inputting balanced signals, respectively, said balanced signals being the same in level and 180 degrees out of phase with each other; and first, second and third lines arranged in such a manner that they are mutually electromagnetically coupled;

said first line having a first end connected to said unbalanced port and a second end connected to ground;

said second line having a first end and a second end, the second end of said second line being connected to said first balanced port;

said third line having a first end connected to said first end of said second line and a second end connected to said second balanced port.

33. The 3-line balun transformer as set forth in claim 32, wherein said first, second and third lines each have a length of $\lambda/4$ ($\lambda$ is a wavelength at a center frequency of an input/output signal).

34. The 3-line balun transformer as set forth in claim 32, wherein said transformer satisfies an impedance condition expressed by the following equation:

$$\frac{1}{Z_{13}} - \frac{1}{Z_{12}} = \frac{1}{Z_{22}} - \frac{1}{Z_{33}} = \pm\sqrt{\frac{2}{Z_{0u}Z_{0b}}}$$

where, $z_{mn}$ (m,n=1,2,3) is a characteristic impedance between an mth line and an nth line, $Z_{0u}$ is a termination impedance of said unbalanced port, and $Z_{0b}$ is a termination impedance of each of said first and second balanced ports.

* * * * *